US006623214B1

(12) United States Patent
Hauske et al.

(10) Patent No.: US 6,623,214 B1
(45) Date of Patent: Sep. 23, 2003

(54) MODIFICATION OF GEOTEXTILE TUBES

(75) Inventors: Gerald J. Hauske, Corpus Christi, TX (US); James A. Shiner, Corpus Christi, TX (US)

(73) Assignee: Shiner Moseley & Associates, Inc., Corpus Christi, TX (US)

( * ) Notice: Subject to any disclaimer, the term of this patent is extended or adjusted under 35 U.S.C. 154(b) by 0 days.

(21) Appl. No.: 10/135,939

(22) Filed: May 2, 2002

(51) Int. Cl.[7] ..... E02D 17/20
(52) U.S. Cl. ..... 405/302.7; 405/32; 428/63
(58) Field of Search ..... 428/63; 405/32, 405/33, 18, 302.6, 302.7, 91, 115

(56) References Cited

U.S. PATENT DOCUMENTS

| | | | | | |
|---|---|---|---|---|---|
| 649,415 | A | * | 5/1900 | Shaffer | 428/63 |
| 2,620,852 | A | * | 12/1952 | Forbush | 156/91 |
| 4,036,674 | A | * | 7/1977 | Labenz | 156/98 |
| 4,966,491 | A | * | 10/1990 | Sample | 405/19 |
| 5,023,987 | A | * | 6/1991 | Wuepper et al. | 29/402.11 |
| 5,034,254 | A | * | 7/1991 | Cologna et al. | 428/63 |
| 5,158,395 | A | * | 10/1992 | Holmberg | 405/21 |
| 6,013,343 | A | * | 1/2000 | Radke et al. | 428/63 |
| 6,056,438 | A | * | 5/2000 | Bradley | 383/66 |
| 6,179,521 | B1 | * | 1/2001 | Muramatsu et al. | 405/115 |
| 2002/0131827 | A1 | * | 9/2002 | Spangler et al. | 405/302.6 |

FOREIGN PATENT DOCUMENTS

| | | | | | |
|---|---|---|---|---|---|
| JP | 402164925 | A | * | 6/1990 | 405/17 |

* cited by examiner

*Primary Examiner*—Heather Shackelford
*Assistant Examiner*—Lisa M. Saldano
(74) *Attorney, Agent, or Firm*—G. Turner Moller

(57) ABSTRACT

An opening in a fabric geotextile tube is closed by clamping a backing member and friction enhancer on the inside of the geotextile tube to a friction enhancer and support on the outside of the geotextile tube. The friction enhancers reduce slippage between the fabric and the backing member on the inside of the tube and between the fabric and the support on the outside of the tube. The backing member is larger than the opening. In one embodiment, the backing member is inserted into the opening by providing a slit ring backing member, inserting the fabric through the slit and then rotating the ring and advancing the ring into the geotextile tube. In another embodiment, the backing member is inserted through the opening in segments. In another embodiment, an inlet assembly is provided by the support. In another embodiment of the invention, a connection is made to the geotextile tube for securing a UV protective cover to the geotextile tube. In another embodiment of the invention, a more elaborate friction enhancer is provided.

25 Claims, 7 Drawing Sheets

FIG.1
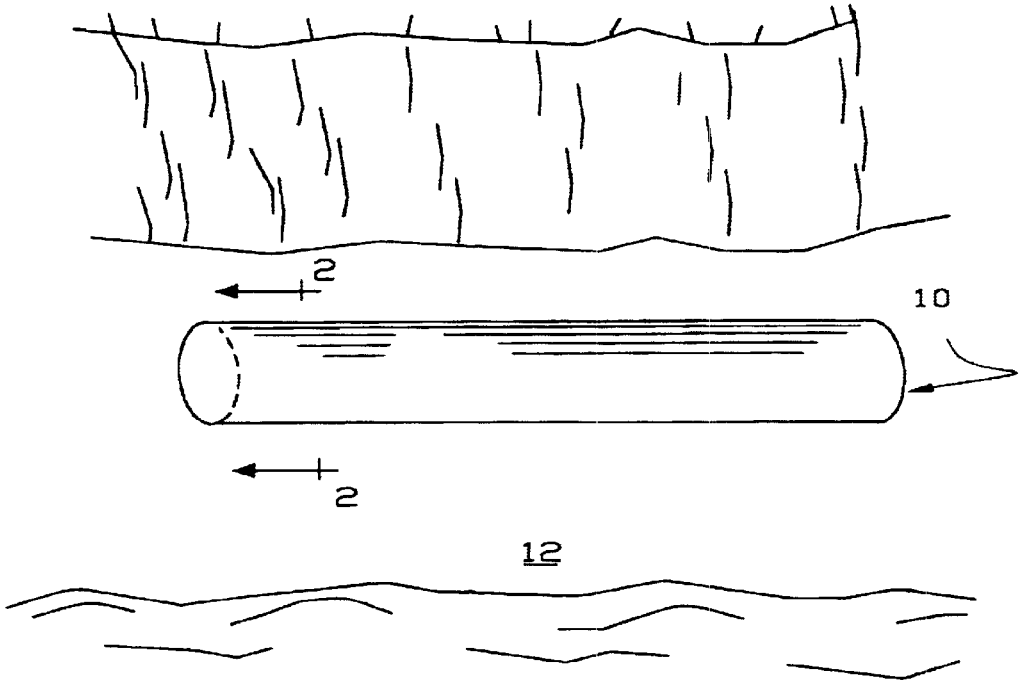
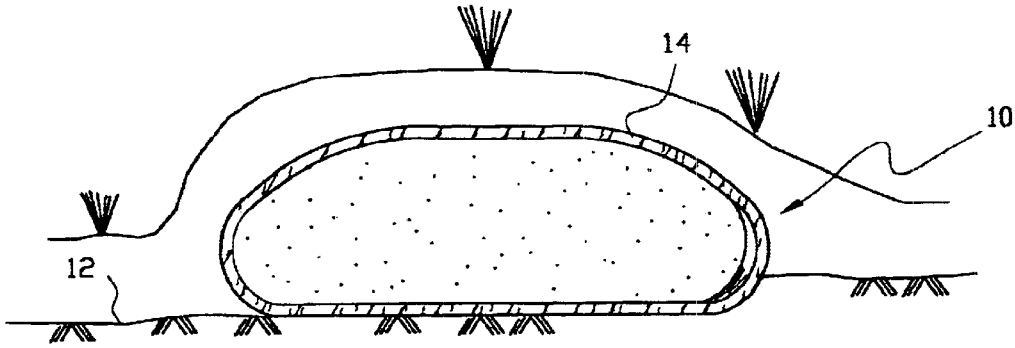
FIG.2

144
146
148
150
152
154
156
158
160
162
164
166
168
170
172
174
11

FIG18
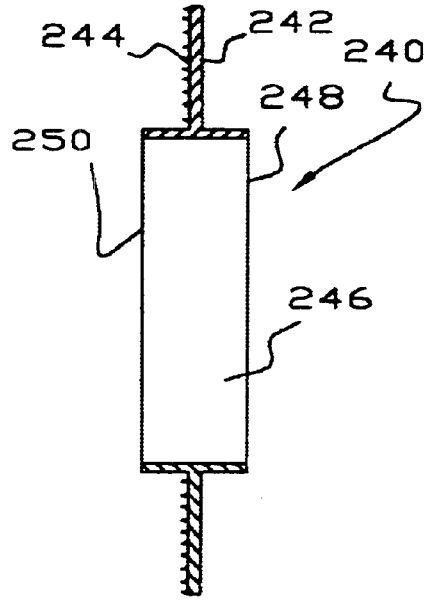
FIG17
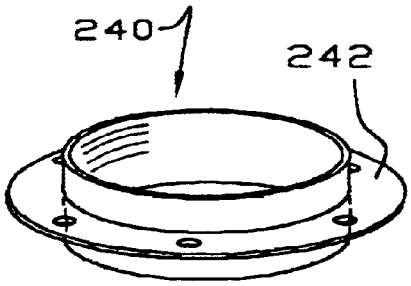
FIG16
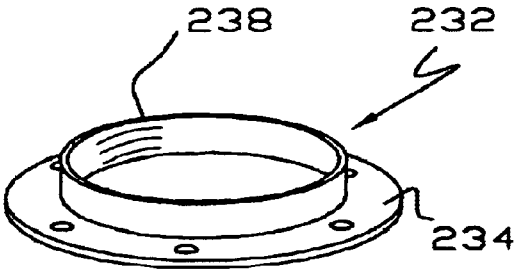
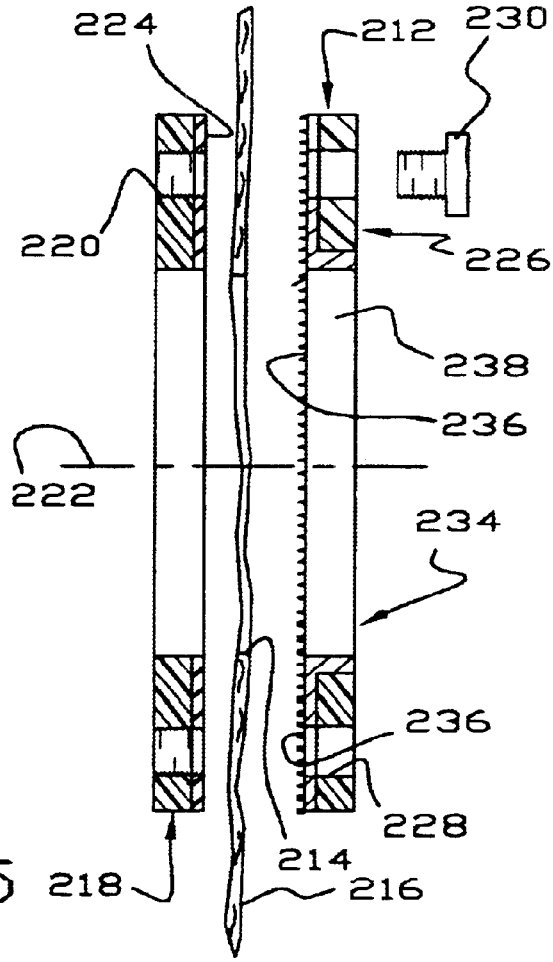
FIG15

MODIFICATION OF GEOTEXTILE TUBES

This invention relates to the modification of geotextile tubes and more particularly to the repair of holes in geotextile tubes, to the preparation of inlets and other openings into geotextile tubes and to mechanical seaming of geotextile fabric for replacement or attachment of geotextile tube components.

BACKGROUND OF THE INVENTION

Geotextile tubes are a relatively recent development in coastal engineering and are large sand filled fabric tubes used to control erosion, protect structures, promote dune building, protect or create environmentally sensitive habitat and the like. Even more recently, geotextile tubes have been proposed for dewatering municipal and industrial waste slurries and providing a technique for handling municipal and industrial particulate byproducts or wastes. Geotextile tubes are a tough coarsely woven fabric, known as a geotextile, perhaps thirty feet in periphery and of considerable length. As used in coastal engineering applications, they are placed in the desired position and then filled with sand by pumping water into the tube and then pumping a sand-water slurry into the geotextile tube and displacing the water. The geotextile is designed to be sufficiently permeable to allow the water to escape, leaving the tube filled with sand. Sand is a term of the trade because the material pumped into the geotextile tube is more accurately described as clastics or particulate earth materials, the proportion of sand to clay, or sand to shells or sand to organic material being whatever is available in the area. An example of a geotextile tube is found in U.S. Pat. No. 5,158,395. As used in handling municipal and industrial slurries, the geotextile tubes are filled by pumping the slurry into the tubes which dewater the slurry and contains the particulates.

Geotextile tubes are manufactured by sewing together the edges of large tough woven fabric mats and are offered commercially by several manufacturers, such as TC Mirafi of Pendergrass, Ga. Geotextile tubes are generally made to order so the length and periphery is determined from engineering considerations and the geotextile tubes made accordingly. Geotextile tubes are sewn at a manufacturing facility to the desired periphery and cut to the desired length. When filled, geotextile tubes are not cylindrical but have a generally flat bottom mimicking the underlying ground surface and arcuate sides and tops so the resultant structure is somewhat ovoid.

One of the problems with geotextile tubes is faced during construction because suitable inlets have to be provided for pumping sand into the geotextile tube and the inlets have to be closed on completion. Another problem with geotextile tubes involves the development of openings or tears in the fabric allowing the sand to wash out, particularly if the geotextile tube is subject to wave action. Inadvertent tears or openings develop over the years from a variety of causes such as imperfect factory sewn seams, UV damage to the fabric, punctures, tears or mechanical abrasion as may occur when driftwood is beaten by waves against the geotextile tube.

The current approach is to close the inlet openings and any inadvertent tears or openings by sewing the edges of the fabric together in the field. These hand sewn repairs have not withstood the test of time.

Disclosures of general interest relative to this invention are found in U.S. Pat. Nos. 649,415; 2,620,852; 4,036,674; 5,023,987 and 6,013,343.

SUMMARY OF THE INVENTION

This invention is directed to the closing of inadvertent openings in an existing geotextile tube, the preparation of inlet openings and their closing when the geotextile tube is filled and the provision of seams mechanically joined in the field. Several considerations dominate this analysis. First, the load on the geotextile tube is quite large, as can be imagined by the weight of a sand filled tube having a 30' periphery. This has proved to be the ultimate factor defeating field sewing a patch onto the tube. In a way, this has been a surprise because the strength of the material around any inadvertent opening has adjusted to accommodate any force attempting to increase the size of the opening and has stopped any tear. In reality, what has occurred is that the material around the opening has temporarily stopped the tear. When the material inside the tube shifts or wave action recommences, the opening enlarges. This corroborates the belief that the largest forces applied to the tube occur when filling the tube or when sand inside the tube is shifting in response to movement of fill out of an opening. Second, the interior of the geotextile tube is inaccessible by which is meant that the interior of the tube is not accessible except through the opening that is to be closed. Thus, one cannot insert a large rigid structure through the opening into the tube unless the opening is significantly longer than it is wide.

On reflection, it is apparent that the preparation of an opening for use as an inlet and its ultimate closing is the same problem as the closing of an inadvertent opening. In this invention, a backing member larger than the opening is passed through the opening into the geotextile tube. The backing member is connected by fasteners extending through the geotextile to a support on the outside of the geotextile tube to provide a clamp for clamping a closure member over the opening. In one embodiment of this invention, the backing member may be a split ring so the edge of the fabric opening is placed through the slit and the ring rotated so it is advanced into the interior of the geotextile tube. In another embodiment of this invention, the backing member is split into segments which are separately passed through the opening into the interior of the geotextile tube and then assembled.

An important feature of this invention is the provision of friction enhancers acting between the backing member and the inside of the geotextile tube and/or between the support and the outside of the geotextile tube. When sliding across each other, the backing member, support and geotextile tube fabric exhibit relatively low coefficients of friction. When clamped together with spaced apart fasteners, the fabric between the fasteners tends to move, under load, relative to the fasteners thereby placing the entire load on the fabric immediately adjacent the fasteners. In this invention, friction enhancers are provided between the backing member and the fabric and/or between the support and the fabric so the load applied to the fabric is not concentrated immediately around the fasteners. In other words, the friction enhancers change the connection from a bearing connection effective over a small area around the fasteners to a friction connection effective over a much larger area. The larger area of the connection of this invention reduces the force applied per unit area to the assembly thereby providing a more durable connection.

The same technique that is used to repair an inadvertent opening is used to prepare an inlet opening so that fill material may be pumped into the geotextile tube. The support on the outside of the geotextile tube provides a through passage and a bearing surface to receive a fabric conduit providing a flow passage for a sand-water slurry. One or more bands are applied between the bearing surface and the fabric conduit. When the tube is filled, the bands and fabric conduit are removed and the opening through the support is closed.

In another aspect of this invention, a connection is made between the geotextile and another fabric, such as a UV protection cover by advancing a connection through the fabric in a manner similar to advancing the split ring through the opening into the geotextile tube. In this embodiment, a helical spring is advanced through the weave of the geotextile and the second fabric to make a connection and the helical spring is locked against normal spreading.

It is an object of this invention to provide an improved geotextile tube.

Another object of this invention is to provide a geotextile tube having an opening modified by an improved technique.

A further object of this invention is to provide an improved method of modifying a geotextile tube.

A still further object of this invention is to provide an improved mechanical seam for geotextile tubes.

These and other objects of this invention will become more fully apparent as this description proceeds, reference being made to the accompanying drawings and appended claims.

BRIEF DESCRIPTION OF THE DRAWINGS

FIG. 1 is a pictorial view of a typical geotextile tube;

FIG. 2 is a cross-sectional view of a typical geotextile tube after the accretion of sand forms a typical dune;

FIG. 15 is an exploded cross-sectional view of another embodiment of this invention;

FIG. 16 is an isometric view of a friction enhancer incorporated in the embodiment of FIG. 15;

FIG. 17 is an isometric view of a modification of FIG. 16; and

FIG. 18 is a cross-sectional view of the embodiment of FIG. 17, taken substantially along line 17—17, as viewed in the direction indicated by the arrows.

DETAILED DESCRIPTION

Referring to FIGS. 1 and 2, a conventional geotextile tube 10 is illustrated as positioned along a beach 12 to control erosion and promote the building of a dune around and landward of the geotextile tube 10. As will be apparent to those skilled in the art, the tube 10 may also be used as a groin, a breakwater or other application in coastal engineering or as a receptacle for receiving and dewatering municipal or industrial wastes in the form of slurries. The geotextile tube 10 is made of a geotextile 14 and filled with sand, particulate earth materials or municipal or industrial waste slurries. The phrase fill material is used herein to designate such particulates or slurries.

Figure 3:
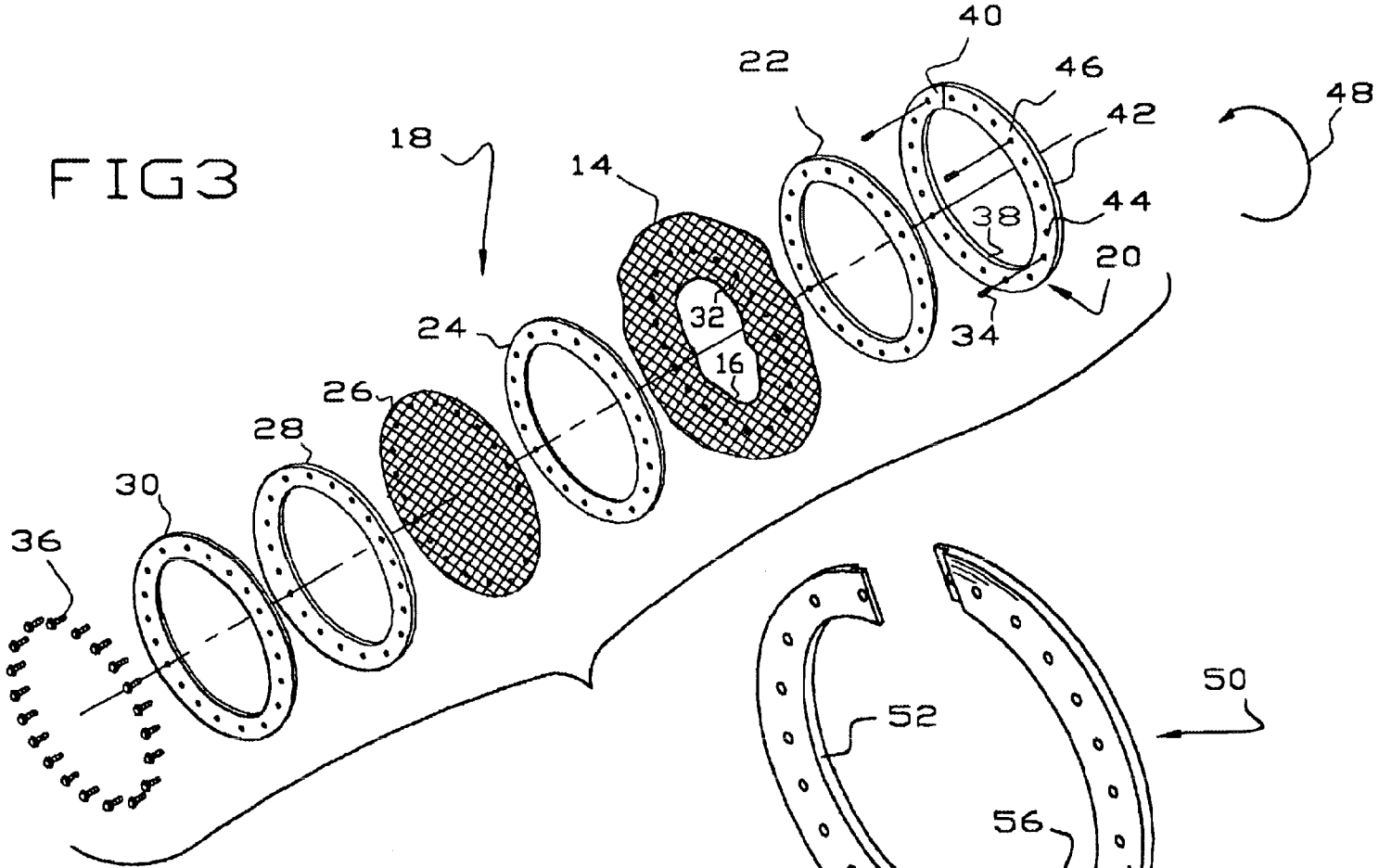
FIG. 3 is an exploded isometric view of one embodiment of this invention, illustrating the repair of an inadvertent opening.

As shown in FIG. 3, a hole 16 has inadvertently developed in the geotextile 14 and is repaired with an assembly 18 of this invention. The assembly 18 comprises a backing member 20, a friction enhancer 22, a friction enhancer 24, a patch or cover 26, a friction enhancer 28 and a support 30. A series of holes 32 are formed in the geotextile 14 around the opening 16 to provide passage for temporary fasteners 34 and for permanent fasteners 36 as will become more fully apparent hereinafter. The holes 32 are typically marked using one of the friction enhancers 28 or support 30 as a guide and then cut with a utility knife, punch or soldering iron.

The threads of the geotextile 14 are prone to unravel. Accordingly, where conditions permit, the exposed ends of the threads are preferably fused in a conventional manner, as by heating them with a soldering iron or torch. This melts the threads, which are typically polyester, thereby forming fused beads on the exposed ends of the threads and preventing them from unraveling.

The backing member 20 is larger than the opening 16 because it must surround the opening 16 to provide part of a mechanism clamping a closure, which in FIG. 3 is the patch 26, to the geotextile tube 10. The interior of the geotextile tube 10 is inaccessible by which is meant that the interior is accessible only through the opening 16. In the event the opening 16 is long relative to its height, an oblong backing member 20 may be provided so the minimum dimension can be passed through the opening 16 and the backing member 20 rotated to align its long dimension with the long dimension of the opening 16. If the opening 16 is relatively circular, by which is meant the minimum dimension of the backing member 20 is larger than the maximum dimension of the opening 16, another approach must be used.

The backing members 20 and supports 30 are made of any suitable material. Preferably, the backing member is made of a non-corrodible rigid or semi-rigid material, such as stainless steel, aluminum, aluminum alloys, or some woods such as teak or cypress, but ideally are of a plastic or organic polymeric material such as high density polypropylene. In the embodiment of FIG. 3, the backing member 20 is of ring or annular shape having an inner diameter 38 and a slit 40 connecting the inner diameter 38 with the periphery 42 thereby providing a split ring backing member. A series of holes 44 extend around the backing member 20 in a pattern reminiscent of a bolt pattern in a flange or manway cover. The holes 44 are threaded to receive the temporary fasteners 34 and the permanent fasteners 36. Thus, the backing member 20 may be cut from a sheet of high density polyethylene and threaded with conventional tools.

To get the backing member 20 inside the geotextile tube 10, the ring is spread at the slit 40 and one end 46 is placed inside the opening 16. The ring 20 is then rotated in a counterclockwise direction suggested by the arrow 48 to advance the backing member 20 into the interior of the geotextile tube 10. When the backing member 20 is inside the geotextile tube, the friction enhancer 22 is inserted through the opening 16 and placed over the temporary fasteners 34 which are conveniently all thread segments which act as alignment studs. The backing member 20 is placed against the inside of the geotextile tube 10 so the temporary fasteners 34 extend through the appropriate holes 32 in the geotextile tube 10. Suitable washers and nuts (not shown) are used to attach the backing member 20 in position around the hole 16.

The friction enhancer 24 is placed against the outside of the geotextile tube 10 by individually removing nuts and washers (not shown) from the temporary fasteners 34, placing the friction enhancer 24 over the bared ends of the fasteners 34 and then reapplying the washers and nuts. The patch 26 and the friction enhancer 28 may be assembled at the same time or may be assembled separately by selectively removing the nuts and washers from the temporary fasteners 34, slipping the elements over the fasteners 34 and then reapplying the nuts and washers. When the support 30 is assembled around the opening 16, the temporary fasteners 34 are removed and replaced by the permanent fasteners 36 and tightened suitably.

If the hole 16 is sufficiently small, meaning that the backing member 20 and support 30 are reasonably small, it will be seen that the temporary fasteners 34 need not be used to clamp the backing member 20 temporarily to the geotextile tube 10. Instead, the fasteners 34 may be used solely as alignment studs with the backing member 20 being supported by workmen as the support 30 is applied and attached with the fasteners 36.

The friction enhancers 22, 24, 28 act to increase the coefficient of friction acting between the backing member 20, the geotextile tube 10, the patch 26 and the support 30 to increase the area over which the clamping forces are applied thereby providing a durable connection as will be more fully apparent hereinafter. The friction enhancers may be of a variety of types, including a separate member as shown, a layer bonded to the backing member 20, patch 26 and support 30, or a surface treatment of the backing member 20, patch 26 and support 30, or a combination thereof. In practice, the provision of a friction enhancer layer separate from the backing member 20 and support 30 has proved effective. The material of the friction enhancers is subject to wide variation and the effectiveness of any particular material is easily determined by simple testing. One group of materials that has proved suitable are synthetic and natural rubber and compounds having the characteristics of rubber, hereinafter called rubberoids or rubberoid compounds. An imminently suitable material has proved to be a common rubber material such as neoprene rubber, which is widely available. In general, the friction enhancers have higher coefficients of friction on the outer surfaces thereof than do the backing members and supports or have higher coefficients of friction, when abutted against the backing members and supports, than the backing members and supports do alone.

Like the backing member 20, the support 30 is preferably made of a non-corrodible material, such as stainless steel or aluminum alloys, and is ideally a plastic or polymeric organic material, such as high density polyethylene. Thus, the support 30 may be cut from sheets of material using conventional tools. It will be apparent that the backing member 20 and support 30 may be made of different shapes to more nearly match the shape of the opening 16. Thus, the backing member 20 and support 30 and may be straight or annular such as circular as shown or may be oblong, oval, rectangular or of compound shape.

The temporary fasteners 34 may be of any suitable threaded stock, such as mild steel. The permanent fasteners 36 are preferably made of a non-corrodible material such as aluminum, aluminum alloys or plastic but ideally are of stainless steel.

Figure 4:
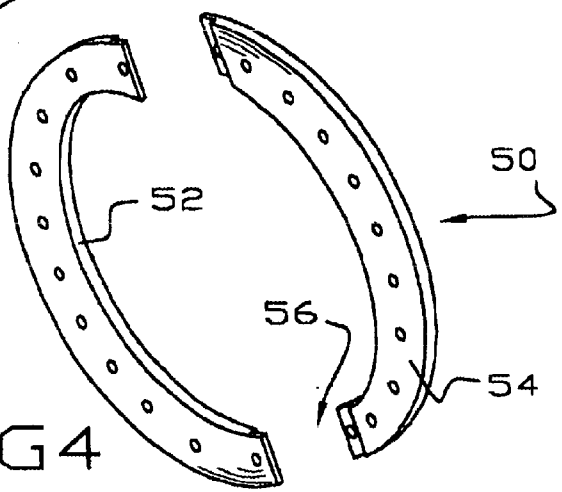
FIG. 4 is an exploded isometric view of another embodiment of this invention.

Referring to FIG. 4, a modified backing member 50 is illustrated as being split into segments 52, 54. The segments 52, 54 have a minimum dimension enabling the segments 52, 54 to be passed separately through the opening 16. Once inside the geotextile tube 10, the segments 52, 54 are connected together in any suitable fashion, as by a half lap joint 56. The joint 56 may be glued together or secured by a threaded fastener.

Figures 5, 6:
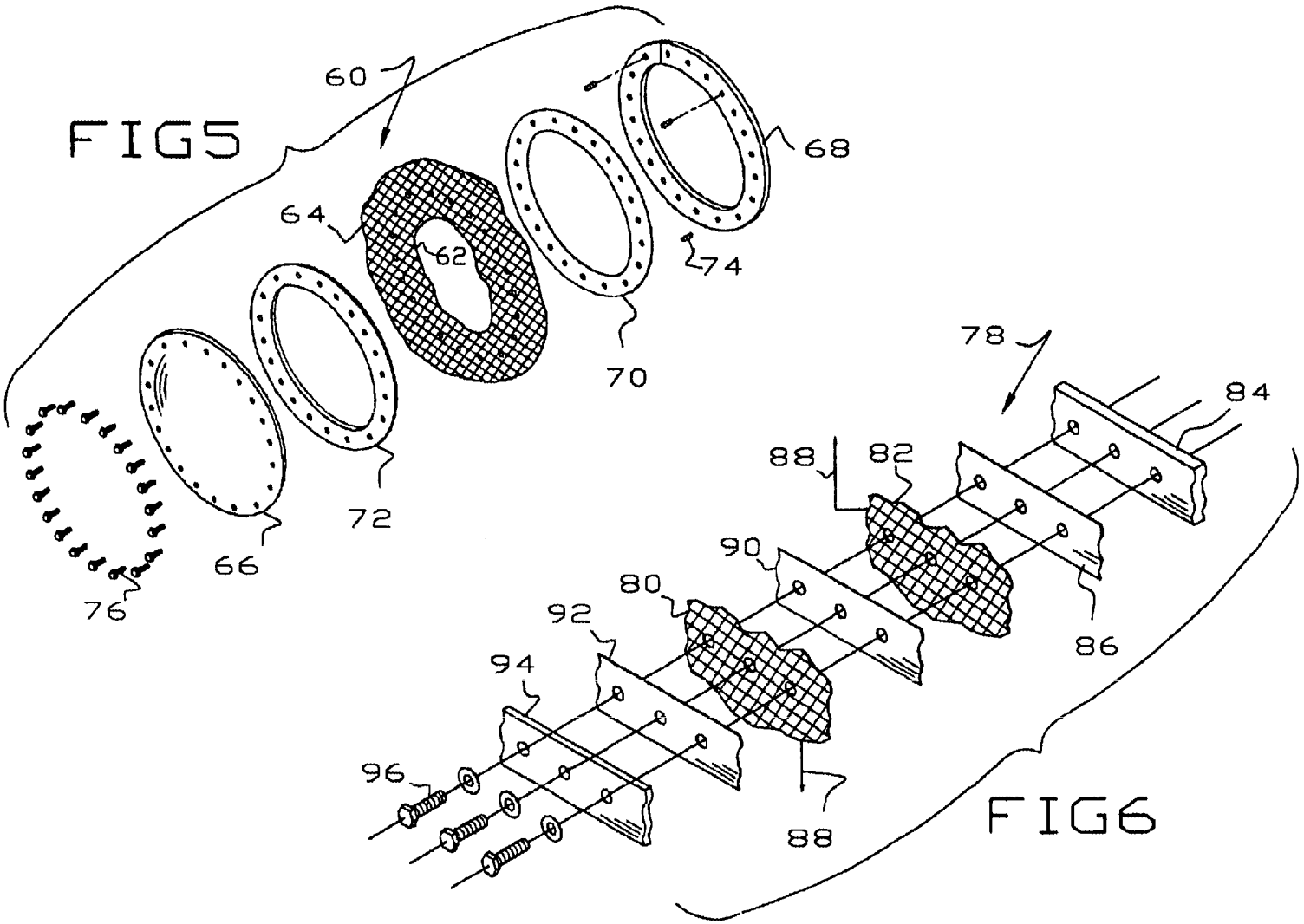
FIG. 5 is an exploded isometric view of another embodiment of this invention.
FIG. 6 is an exploded isometric view of another embodiment of this invention.

Referring to FIG. 5, there is illustrated another assembly 60 of this invention used to close an opening 62 in a geotextile tube fabric 64. The assembly 60 differs from the assembly 18 in that the support 66 acts to close the opening 62 rather than using the fabric patch 25 for this purpose.

To this end, the assembly 60 comprises a backing member 68 and a friction enhancer 70 on the inside of the geotextile tube fabric 64 and a friction enhancer 72 and support 66 on the outside of the geotextile tube fabric 64. A series of temporary fasteners 74 are used as alignment studs as previously discussed to allow permanent fasteners 76 to clamp the support 66 to the backing member 68 to close the opening 62.

Referring to FIG. 6, there is illustrated another embodiment of this invention which is a mechanical splice used in lieu of a field sewn seam. The assembly 78 differs from the assemblies 18, 60 because the elements are straight rather than being closed. The assembly 78 is used to mechanically connect overlapping ends of a pair of geotextile fabrics 80, 82 and comprises a backing member 84 and a friction enhancer 86 on the inside of the geotextile fabric 80, a friction enhancer 90 between the geotextile fabrics 80, 82, a friction enhancer 92 on the outside of the fabric 82 and a backing member 94. A series of temporary fasteners (not shown) are used as alignment studs as previously discussed to allow permanent fasteners 96 to clamp the supports 94 to the backing members 84 thereby clamping the ends of the fabrics 80, 82 together.

The assembly 78 is of particular interest because it is of a geometry that is suitable for tension strength testing and has been subjected to tests showing the effectiveness of the joint and particularly of the friction enhancers. A 10" wide fabric sample was placed in an test fixture and subjected to a tensile force tending to pull the sample apart as prescribed in ASTM D4884. The nominal strength of the fabric was 1000 pounds per inch of fabric width. A tensile force was applied to the sample until the material failed. A total of six tests were run. The results are as follows:

TABLE I

| Strength of Fabric Force applied at failure in pounds per inch of fabric width | | | |
|---|---|---|---|
| Test 1 | 1230 | Test 4 | 1362 |
| Test 2 | 1370 | Test 5 | 1228 |
| Test 3 | 1417 | Test 6 | 1281. |

The mean force at failure was 1315 pounds per inch of width with a standard deviation of 73.

A 10" wide fabric sample was placed in an test fixture as prescribed in ASTM D4884. The sample had a factory sewn seam running across the width of the material. The seam was a butterfly type seam, 3.75 stitches per inch with two rows of stitches using a thread comparable to the thread in the fabric material. The fabric was of the same batch as in Table I or was of comparable material. Tension was applied to the sample until the joint failed. A total of six tests were run. The results are as follows:

TABLE II

Strength of Factory Sewn Seam

| | Force applied at failure in pounds per inch of fabric width | Failure mode |
|---|---|---|
| Test 1 | 570 | failure in material |
| Test 2 | 499 | failure in material |
| Test 3 | 565 | failure in stitching |
| Test 4 | 545 | failure in material |
| Test 5 | 506 | failure in material |
| Test 6 | 513 | failure in material. |

The failure in the material was noted to be immediately adjacent the sewn seam as opposed to failure unrelated to the sewn seam. The mean force at failure was 533 pounds per inch of width with a standard deviation of 28. Thus, the factory sewn seam was 41% efficient, meaning that it had 41% of the strength of the fabric at failure.

A 10" wide fabric sample was placed in an test fixture as prescribed in ASTM D4884. The sample had a mechanical splice in accordance with FIG. 6 securing the ends of fabric pieces together. A 10" long×3" wide×⅜" thick backing members 84 on top and a 10" long×3" wide×¾" thick backing member 94 on bottom were clamped on opposite sides of fabric pieces. Three ½" bolts on 3" centers clamped the backing members 84, 94 together. The edge of the backing members was 2" beyond each side of the outside fastener center line and coterminous with the edge of the fabric. A load was applied to the fabric samples, mimicking the situation where a load is applied to the fabric sections 80, 82 as suggested by the arrows 88 in FIG. 6. The fabric was of the same batch as in Table I or was of comparable material. Tension was applied to the sample until the joint failed. A total of six tests were run with the friction enhancers 86, 90, 92 and six tests were run without friction enhancers. The results are as follows:

TABLE III

Strength of Mechanical Splice of FIG. 6

| | With friction enhancers Force applied at failure in pounds per inch of fabric width | Without friction enhancers Force applied at failure in pounds per inch of fabric width |
|---|---|---|
| Test 1 | 298 | 233 |
| Test 2 | 305 | 257 |
| Test 3 | 302 | 217 |
| Test 4 | 299 | 277 |
| Test 5 | 300 | 215 |
| Test 6 | 316 | 184 |

All failures were in the material slipping relative to the backing members. The mean strength of the mechanical joint with friction enhancers was 303 pounds per inch of width with a standard deviation of 6, meaning that the efficiency of the joint was 23% of the strength of the fabric. The mean strength of the mechanical joint without friction enhancers was 231 pounds per inch of width with a standard deviation of 30, meaning that the efficiency of the joint was 18% of the strength of the fabric. Thus, the conclusions to be drawn from these tests are that the friction enhancers increase the strength of the joint significantly, typically on the order of about 30% on the specimens and design tested, and also produce much more consistent connections as shown by a comparison of the standard deviations, i.e. 6 versus 30. From the stand point of deciding what is a minimum reliable strength of the joint without friction enhancers, one would have to conclude it is below 184 pounds per inch of width whereas a reliable strength to the joint with friction enhancers would be in the neighborhood of 290 pounds per inch of width which is an increase of about 60%. It is believed the friction enhancers will contribute significantly to the strength of a joint in accordance with FIG. 6 but also to the strength of a patch across an opening and thereby promote durability of geotextile closures of this invention.

While the tests shown in Table III demonstrate the effectiveness of the clamped joint of FIG. 6, it is apparent the joint can be made stronger and/or more convenient. For example, two rows of bolts that are offset will produce a stronger joint. In addition, the use of adhesives on, or as, the friction enhancers creates a more effective bearing area between the clamped backing members and supports. In particular, a double faced adhesive tape used as the friction enhancers or on as the friction enhancers or a spreadable adhesive on or as the friction enhancers is effective. In the tested devices, the backing members and supports were of high density polyethylene that were relatively slick.

Figure 7:
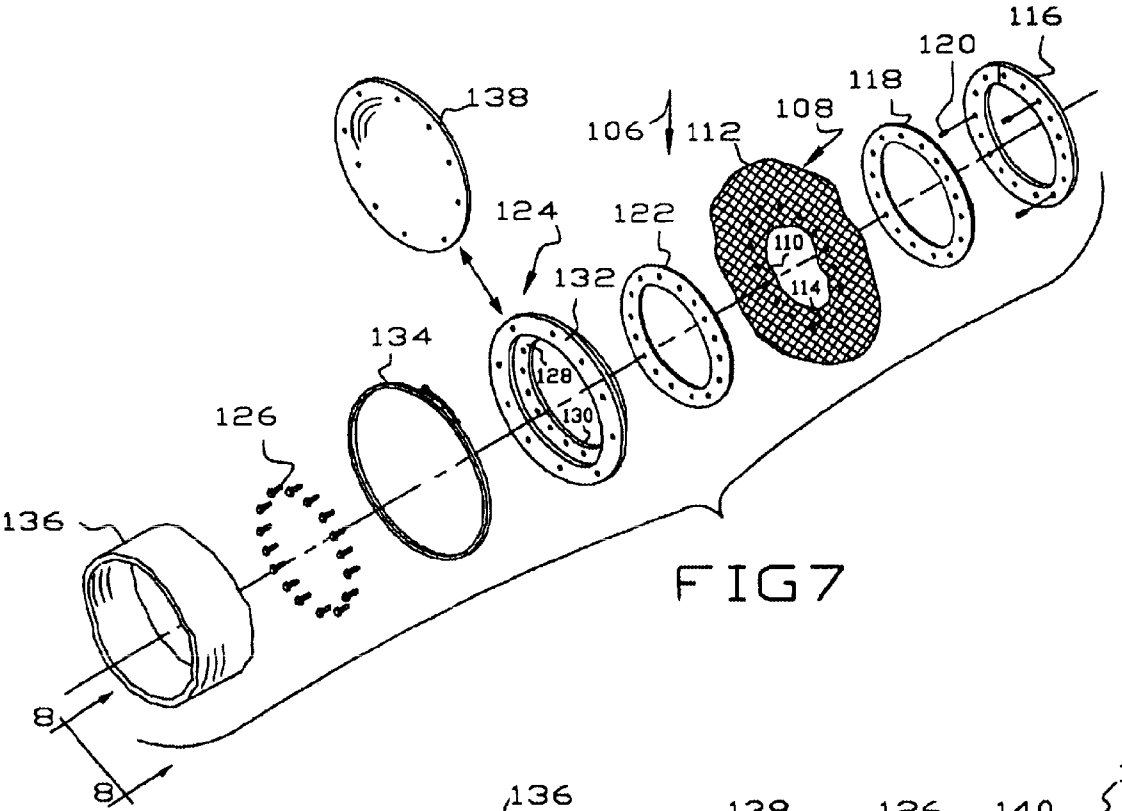
FIG. 7 is an exploded isometric view of another embodiment of this invention.
Figure 9:
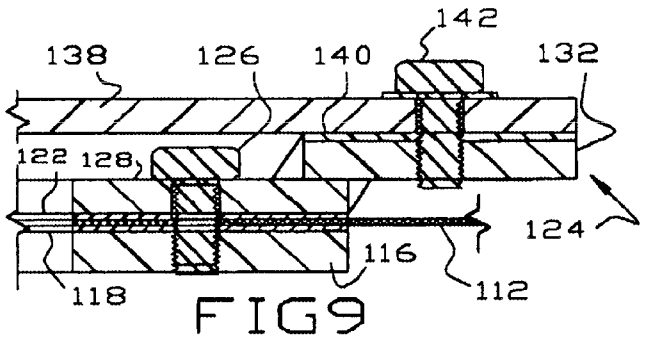
FIG. 9 is a cross-sectional view of another embodiment of this invention, taken similarly to FIG. 8.
Figure 8:
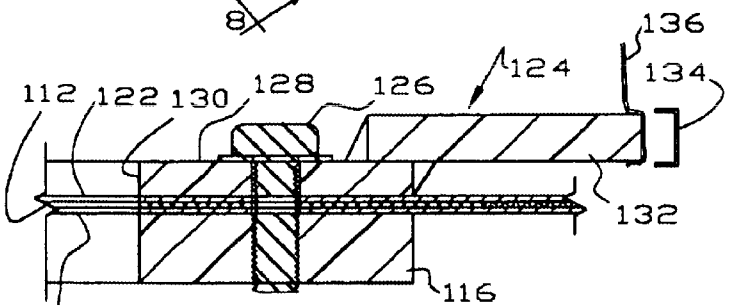
FIG. 8 is an enlarged cross-sectional view of the embodiment of FIG. 7, taken along line 8—8 thereof as viewed in the direction indicated by the arrows.

Referring to FIGS. 7–9, an assembly 106 is provided for creating an inlet for filling a geotextile tube 108 with fill material by pumping a sand-water slurry into the geotextile tube 108. An opening 110 is cut through the geotextile 112 and a series of holes 114 is cut around the opening 110. A backing member 116 and friction enhancer 118 are aligned with the holes 114 by using threaded alignment studs 120 as previously mentioned. A friction enhancer 122 and filling flange 124 are clamped to the backing member 116 by use of threaded fasteners 126.

The filling flange 124 provides a support 128 having a through passage 130 for delivering the slurry into the geotextile tube 112. The flange 124 provides an axially offset circumferential flange or rim 132 secured to the support 128 in any suitable manner, as by gluing, welding or heat molding, which receives a band clamp 134. A conventional flexible fill tube 136 is stretched over the rim 132 and secured in place by the clamp 134. The band clamp 134 may be of any suitable type. The fill tube 136 is conventionally made by sewing, i.e. a piece of material of a desired periphery is folded over and sewn along the abutted edges. After the filling operation is complete, the clamp 134 and fill tube 136 are removed. The filling flange 124 remains in place and is closed by a cover plate 138, gasket 140 and fasteners 142 as shown in FIG. 9. The purpose of the gasket 140 is not to provide a seal because, after all, the geotextile fabric is quite permeable. The purpose is to prevent erosion of an unobstructed passage between the flange 132 and the cover plate 138.

Figures 10, 11, 12:
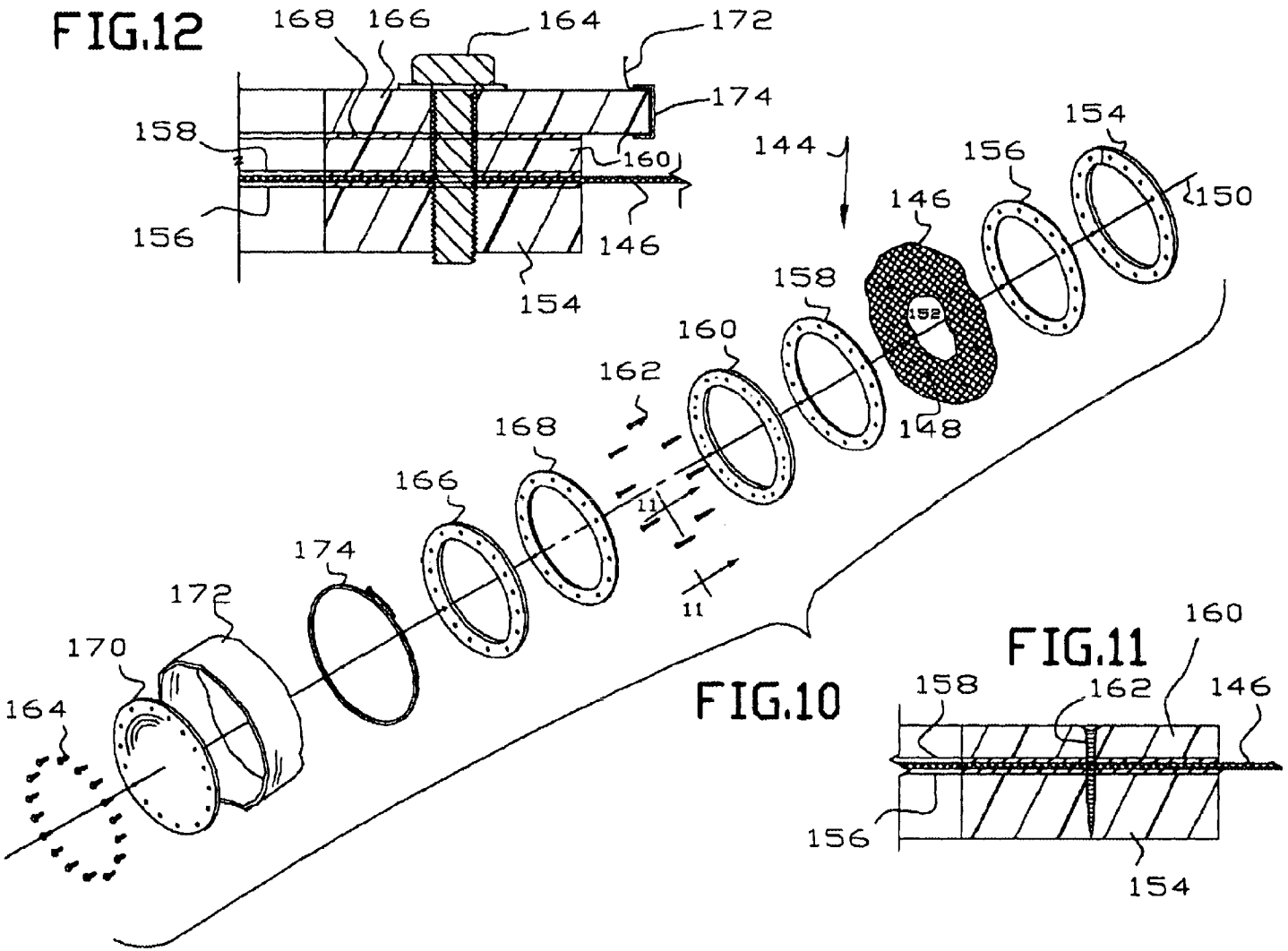
FIG. 10 is an exploded isometric view of another embodiment of this invention.
FIG. 11 is a cross-sectional view of the embodiment of FIG. 10, taken along line 11—11 thereof, as viewed in the direction indicated by the arrows.
FIG. 12 is a cross-sectional view of the embodiment of FIG. 10, taken similarly to FIG. 11, showing a cover plate in position.

Referring to FIGS. 10–12, another simple approach is shown to provide inlet and outlet openings for a geotextile tube. An assembly 144 is provided for creating an inlet for filling a geotextile tube 146 with fill material. A series of holes 148 is cut in a circular pattern around the central axis 150. An opening 152 is cut into the geotextile to allow insertion of a split backing member 154. The backing member 154 and friction enhancer 156 are aligned with the holes 148 by using suitable alignment studs (not shown) as previously mentioned. A friction enhancer 158 and support 160 are clamped to the backing member 154 by use of threaded fasteners 162, as shown in FIG. 11. As is apparent, the threaded fasteners 162 are conveniently permanent fasteners which secure the backing member 154 and support 160 together allowing threaded fasteners 164 to be removed and replaced in order to place a filling flange 166 and gasket 168 in operative position and to replace the filling flange 166 with a cover plate 170.

At least one of the friction enhancers 156, 158 preferably comprises at least one adhesive layer and ideally comprise double faced adhesive tape thereby bonding the backing member 154 and/or the support 160 to the geotextile fabric of the tube 146. By bonding the backing member 154 to the support 160, the strength of the clamped joint is increased substantially.

As shown in FIGS. 10 and 12, the filling flange 166 is temporarily attached to the support 160 and backing member 154 by the removable threaded fasteners 164. A conventional flexible filling tube 172 is secured to the edge of the filling flange 166 by a band clamp 174. When the filling operation is completed, the band clamp 174 and filling tube 172 are removed and the fasteners 164 are unthreaded to remove the filling flange 166. The cover 170 is then bolted to the support 160 and the backing member 154.

Referring to FIG. 10, an important feature of this invention may be visualized. As disclosed above, the filling ports have been installed after the geotextile tubes are in place, as allowed by the split backing members. An important feature of this invention is to install the filling ports, or at least the fixtures for the filling ports, before the geotextile panels have been sewn together. In this situation, the backing members do not have to be split because both sides of the geotextile are accessible. Thus, a solid backing member analogous to member 154 and a support analogous to support 160 may be installed on a fabric panel before the panel is stitched to provide a tube. In this circumstance, the opening through the member 154 and support 160 need not be cut through the geotextile until the tube is in the field and a decision is made to use a particular filling port.

Figure 13:
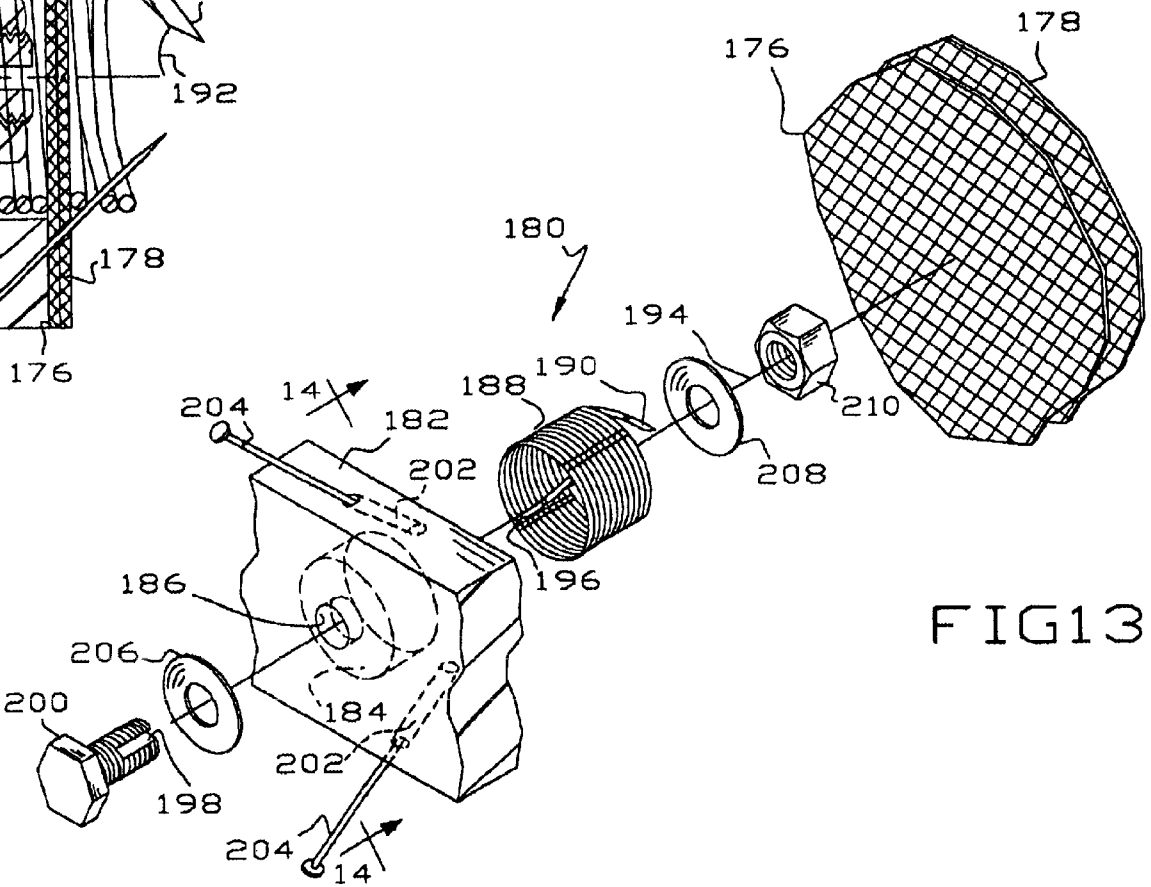
FIG. 13 is an exploded isometric view of another embodiment of this invention.

Referring to FIG. 13, another embodiment of this invention is illustrated. There are numerous situations where it is desirable to attach a fabric piece 176 to a geotextile tube 172 in other situations where there is no hole, meaning there is no access at all into the interior of the geotextile tube. For example, geotextile tubes are often partially covered with a fabric UV shield to minimize UV deterioration of the polyester threads. These UV shields often become detached from the geotextile tubes and begin flapping in the wind or in the waves, thereby increasing deterioration of the shield and the geotextile tube.

A connection 180 is provided for attaching the fabric piece 176 to the geotextile tube 178 in a simple, expeditious manner. The connection 180 comprises a support 182 which extends along the geotextile tube 178 for a length corresponding to the desired length of the connection between the fabric piece 176 and the geotextile tube 178 providing a series of recesses 184 facing the fabric piece 176 and providing a smaller passage 186 opening away from the geotextile tube 178.

A helical spring 188 in the recess 184 provides a pointed end 190 defining an acute angle 192 relative to the axis 194 of the spring 188 for purposes more fully apparent hereinafter. A strut 196 is welded to the opposite end of the spring 188 to provide a drive connection in cooperation with a slot 198 in the end of a threaded fastener 200.

To increase the strength of the connection 180, one or more passages 202 are provided in the support 182 at an angle to intersect the spring 188 at a location between revolutions of the helix which is, of course, inside the geotextile tube 178. Driving a nail 204, sized to snugly fit in the passages 202, into the spring 190 locks up the spring 188 thereby making it considerably more difficult to spread the revolutions of the helix and contributing to the strength of the connection 180.

Figure 14:
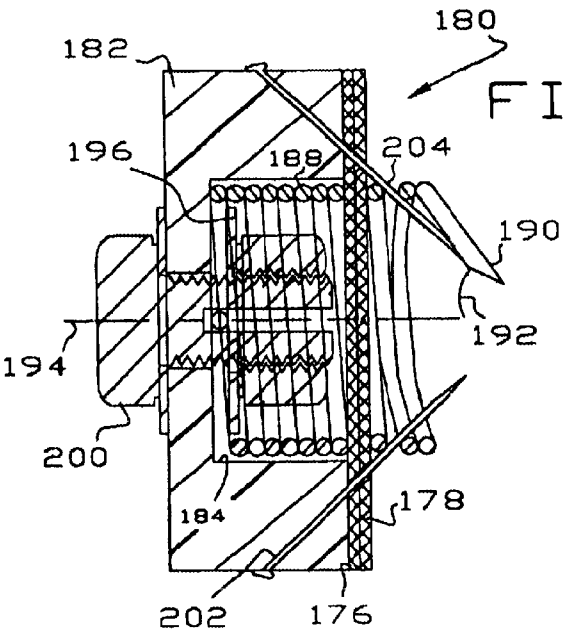
FIG. 14 is a cross-sectional view of the embodiment of FIG. 13, taken substantially along line 14—14 thereof, as viewed in the direction indicated by the arrows.

Assembly and operation of the connection 180 should now be apparent. The fabric piece 176 is placed on the geotextile tube 178 in the desired location. The helical springs 190 are placed in the recesses 184 along the length of the support 182, the fasteners 200 are passed through the passages 186 through the washers 206, 208 and nut 210 so the strut 196 passes into the slot 198 of the fastener 200. The nut 210 is suitably tightened so the washer 208 binds against the strut 196. The support 182 is placed on the fabric piece 176 along the desired line of connection and the fasteners 200 are turned in a clockwise direction with a suitable wrench or screw driver. This advances the pointed end 190 of the spring 188 through the mesh of the fabric piece 176 and geotextile tube 178 so the fabrics are held between the revolutions of the helical spring 188 as shown best in FIG. 14. The nails 202 are driven with a suitable hammer into the spring 188, thereby immobilizing it, and into the fill material inside the tube 178. In the event greater strength is needed, the nails 204 may be hollow and a suitable glue, such as epoxy, injected through the hollow nails into the spring 188. When the glue hardens, the spring 188 should not be able to spread apart thereby increasing the strength of the connection 180.

Referring to FIGS. 15 and 16, there is illustrated another fixture 212 for an opening 214 in a geotextile tube 216. The fixture 212 comprises an annular backing member 218 inside the tube 216 having a series of threaded openings 220 spaced around a centerline 222. A friction enhancer 224 of rubber or rubberoid material is positioned between the backing member 218 and the fabric of the geotextile tube 216.

The fixture 212 also comprises an annular support 226 on the outside of the geotextile tube 216 having a series of unthreaded passages 228 for receiving threaded fasteners 230 for clamping the support 226, the backing member 218 and a friction enhancer 232 together. The friction enhancer 232 comprises a flat annular section 234 of substantially the same inner and outer dimensions as the backing member 218 and support 226 and is typically, but not necessarily, circular. The section 234 provides a large number of protuberances or points 236 facing toward the geotextile tube 216 for increasing the adhesion of the friction enhancer 232 and the support 226 to the backing member 218. The ends of the points 236 are ideally sufficiently small to pass between the fibers of the geotextile fabric and are smooth on the exterior to avoid cutting the fibers. The points 236 are ideally of sufficient length to pass through the geotextile fabric and embed in the friction enhancer 224. In this manner, a large number of connections are provided between the geotextile fabric and the fixture 212.

The friction enhancer 232 also comprises a rim 238 sized to fit snugly in the opening of the support 226. It will be seen that clamping the backing member 218 and the support 226 together tends to impale the points 236 through the fabric of the tube 216 into the friction enhancer 224 thereby reducing slippage between the geotextile material and the fixture 212. In addition, any tendency of the support 226 to move relative to the friction enhancer 232 places the rim 238 in shear.

Referring to FIGS. 17–18, a slightly different embodiment of a friction enhancer 240 comprises a flat annular section 242 having a large number of points or protuberances 244 on one side thereof and a rim 246 sized to fit snugly in the inner openings of both the backing member and support similar to that shown in FIG. 15. The rim accordingly provides ends 248, 250 received in the support and backing member respectively.

The friction enhancers 232, 240 are easily made of a non-corrodible metal such as stainless steel, aluminum alloys or the like and the protuberances 236, 244 are conveniently formed by a die.

Although this invention has been disclosed and described in its preferred forms with a certain degree of particularity, it is understood that the present disclosure of the preferred forms is to only by way of example and that numerous changes in the details of construction and operation and in the combination and arrangement of parts may be resorted to without departing from the spirit and scope of the invention as hereinafter claimed.

We claim:

1. A system for repairing a geotextile tube having a rupture aperture therein, comprising a backing member disposed within the tube adjacent to and having a dimension larger than the aperture;

a friction enhancing element disposed between the backing member and the tube at the aperture and engaging the tube on an inside surface thereof;

an aperture-closing support member disposed externally of the tube;

a second friction enhancing element disposed between the support member and the tube at the aperture and engaging the tube on an outside surface thereof;

and a fastener device firmly connecting the backing and support members and extending through the tube fabric, thereby to close the aperture;

wherein the friction enhancing elements substantially prevent any slippage between the backing and support members and the tube thereby to maintain closure of the aperture during continued service of the tube.

2. The system of claim 1 wherein the aperture-closing member comprises a solid member extending across the opening.

3. The system of claim 1 wherein the fabric is woven organic polymeric material, the fabric and one of the members have a lower coefficient of sliding friction than the fabric and the friction enhancing element.

4. The system of claim 1 wherein the backing member and the support member are of a non-corrodible material.

5. The system of claim 4 wherein the backing member and the support member are made from a group consisting of stainless steel, aluminum, aluminum alloys, wood and organic polymers of sufficient thickness to receive and hold the fasteners.

6. The system of claim 4 wherein the friction enhancing element is made of a material selected from the group consisting of rubber and rubberoid compounds.

7. The system of claim 1 wherein the backing member and the support member are made of an organic polymer.

8. The system of claim 1 wherein the backing member provides a series of threaded openings and the fastener device comprises threaded fasteners threaded into the threaded openings.

9. The system of claim 1 wherein the friction enhancing element comprises a layer of friction enhancing material.

10. The system of claim 9 wherein the friction enhancing element is separate from the backing member.

11. The system of claim 10 wherein the layer of friction enhancing material is selected from the group consisting of rubber and rubberoid compounds.

12. The system of claim 9 wherein the layer of friction enhancing material comprises an adhesive.

13. The system of claim 1 wherein the friction enhancing element comprises a flat section abutting one of the members and having a series of protuberances facing the fabric tube.

14. The system of claim 13 wherein the backing member and support member provide an outer edge and an inner edge and the friction enhancing element provides a rim abutting the inner edge of one of the members.

15. The system of claim 14 wherein the friction enhancing element provides a rim abutting the inner edges of both the backing member and the support member.

16. The system of claim 1 wherein the backing member is larger than the opening and is split thereby allowing the backing member to be inserted through the opening.

17. The system of claim 16 wherein the backing member is an annulus and the ring is split across the annulus allowing the fabric to be inserted into the split and the annulus rotated to advance the annulus into the geotextile tube.

18. The system of claim 16 wherein the backing member is split into separate segments.

19. The system of claim 16 wherein the backing member is a ring.

20. The method of modifying an opening in a fabric geotextile tube having fill material therein wherein an interior of the tube is accessible only through the opening, comprising the steps of inserting a backing member and a first friction enhancer through the opening into the interior of the tube and placing the friction enhancer against an inner surface of the fabric adjacent the opening and positioning the backing member against a surface of the first friction enhancer;

placing a second friction enhancer outside the tube adjacent the opening against an outer surface of the fabric;

placing a support against the second friction enhancer outside of the geotextile tube adjacent the opening;

fastening the backing member and support together and clamping the fabric adjacent the opening between the backing member and the support thereby closing the opening, whereby the friction enhancers substantially prevent slippage between the backing member, the support and the tube thereby maintaining closure of the opening during continued service of the geotextile tube.

21. A geotextile tube comprising a fabric tube having fill material therein and having an opening therein, a closure for the tube opening including a backing member inside the tube around the opening, the backing member having a minimum lateral dimension smaller than a maximum lateral dimension of the tube opening and said backing member further having a maximum lateral dimension greater than said maximum lateral dimension of the tube opening, whereby the backing member may be inserted into the tube through the tube opening, a support member outside the tube around the opening, at least one friction enhancer between one of the said members and the tube for reducing slippage of the said backing and support members relative to the tube, and a series of fasteners beyond the periphery of the opening and extending through the fabric tube connecting the backing and support members and clamping the fabric tube between the said members.

22. The method of claim 20 further comprising the step of placing temporary immobilizing fasteners between the backing member and the fabric geotextile tube prior to placement of the support and then, after fastening the backing member and support together, removing the temporary immobilizing fasteners.

23. A geotextile tube comprising a fabric tube having fill material therein and having an opening therein, a closure for the tube opening including a backing member inside the tube around the opening, the backing member being larger than the opening and being split whereby the backing member may be inserted into the tube through the tube opening, a support member outside the tube around the opening, at least one friction enhancer between one of the said members and the tube for reducing slippage of the said backing and support members relative to the tube, and a series of fasteners beyond the periphery of the opening and extending through the fabric tube connecting the backing and support members and clamping the fabric tube between the said members.

24. The method of claim 20 wherein the step of inserting the backing member comprises inserting a split backing member, larger than the opening, through the opening into an interior of the tube by use of the split.

25. The method of claim 24 further comprising the step of placing temporary immobilizing fasteners between the backing member and the geotextile tube prior to placing the support and then, after fastening the backing member and support together, removing the temporary immobilizing fasteners.

* * * * *